US010173437B2

(12) United States Patent
Strijckers

(10) Patent No.: US 10,173,437 B2
(45) Date of Patent: Jan. 8, 2019

(54) MANUFACTURING OF DECORATIVE LAMINATES BY INKJET

(71) Applicant: AGFA NV, Mortsel (BE)

(72) Inventor: Hans Strijckers, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/820,541

(22) Filed: Nov. 22, 2017

(65) Prior Publication Data

US 2018/0093494 A1 Apr. 5, 2018

Related U.S. Application Data

(62) Division of application No. 15/110,140, filed as application No. PCT/EP2015/050076 on Jan. 6, 2015, now Pat. No. 9,855,767.

(30) Foreign Application Priority Data

Jan. 10, 2014 (EP) ..... 14150788

(51) Int. Cl.

| | |
|---|---|
| ***B41J 3/407*** | (2006.01) |
| ***B41M 5/00*** | (2006.01) |
| ***B41M 7/00*** | (2006.01) |
| ***B44C 5/04*** | (2006.01) |
| ***B41J 2/01*** | (2006.01) |
| ***B41M 5/52*** | (2006.01) |

(52) U.S. Cl.

CPC ..... *B41J 3/407* (2013.01); *B41J 2/01* (2013.01); *B41M 5/0047* (2013.01); *B41M 5/0064* (2013.01); *B41M 7/009* (2013.01); *B44C 5/0469* (2013.01); *B41M 5/5218* (2013.01); *B41M 5/5236* (2013.01); *B41M 5/5254* (2013.01); *B41M 5/5263* (2013.01); *B41M 5/5281* (2013.01)

(58) Field of Classification Search

CPC ..... B43J 3/407; B41J 2/01; B41M 5/0047; B41M 5/0064; B41M 5/0469; B41M 5/5218; B41M 5/5236; B41M 5/5254; B41M 5/5263; B41M 5/5281; B41M 7/009; B44C 5/0469

USPC ..... 347/102

See application file for complete search history.

(56) References Cited

U.S. PATENT DOCUMENTS

2007/0104928 A1* 5/2007 Yokochi ..... B32B 27/08 428/204
2010/0175343 A1* 7/2010 Kruesemann ..... B32B 21/02 52/588.1
2011/0283642 A1* 11/2011 Meirlaen ..... B32B 21/06 52/309.1

OTHER PUBLICATIONS

Strijckers, "Manufacturing of Decorative Laminates by Inkjet", U.S. Appl. No. 15/110,140, filed Jul. 7, 2016.

* cited by examiner

*Primary Examiner* — Huan Tran
*Assistant Examiner* — Alexander D Shenderov
(74) *Attorney, Agent, or Firm* — Keating and Bennett, LLP

(57) ABSTRACT

A method of manufacturing decorative laminates includes the steps of a) inkjet printing a first decorative layer by a first multi-pass inkjet printer and delivering the inkjet printed first decorative layer to a laminate heating press where it is heat pressed into a decorative laminate; and b) inkjet printing a second decorative layer by a second multi-pass inkjet printer and delivering the inkjet printed second decorative layer to the same laminate heating press where it is heat pressed into a decorative laminate.

10 Claims, 2 Drawing Sheets

MANUFACTURING OF DECORATIVE LAMINATES BY INKJET

CROSS-REFERENCE TO RELATED APPLICATIONS

This application is a 371 National Stage Application of PCT/EP2015/050076, filed Jan. 6, 2015. This application claims the benefit of European Application No. 14150788.9, filed Jan. 10, 2014, which is incorporated by reference herein in its entirety.

BACKGROUND OF THE INVENTION

1. Field of the Invention

The present invention relates to the manufacturing of decorative laminates using inkjet technology.

2. Description of the Related Art

Gravure, offset and flexography are being increasingly replaced for different applications by industrial inkjet printing systems, which have now proven their flexibility in use, such as variable data printing making short production runs and personalized products possible, and their enhanced reliability, allowing incorporation into production lines.

Inkjet technology has also been implemented by manufacturers of decorative laminates, such as laminate floor. In view of the high through-put in the laminate manufacturing line (usually about 600 paper sheets/hour of 5.60 m×2.07 m or about 1200 paper sheets/hour of 2.80 m×2.07 m), single pass inkjet printers have been installed in-line.

A general set-up of a manufacturing line having an in-line inkjet printer is shown in FIG. 1 of EP 2431190 A (THEODOR HYMMEN). Commercially available single pass inkjet printers for such decorative laminate manufacturing lines are, for example, the Jupiter single pass printers from Hymmen (http://www.xaar.com/18%20may %2009.aspx) and the Palis single pass printing systems (http://www.palis-digital.com/en/portfolio/sp-drucker.html).

In daily practise, these single pass inkjet printers have proven to suffer from major and minor operation failures. A major operation failure is when the single pass inkjet printer is incapable of printing by a technical dysfunction and the manufacturing line has to be stopped. A minor operation failure is when some of the nozzles are failing to jet ink, thereby creating line artefacts in the printed image and leading to waste of material by a cumbersome removal of these defective decorative laminates after heat pressing.

A solution to these problems would be to place two single pass inkjet printers into a decorative laminate manufacturing line. However, this is an uneconomical solution. For example, a Hymmen Jupiter JPT-W printing with CMYK inkjet inks contains 320 inkjet print heads to cover a width of 2.20 m, which makes it a very costly machine.

Another issue is that, although inkjet printing has the potential of unlimited variable printing, problems of data streaming to the inkjet printer occurred. The variable images to print required such a high computing power that limitations in the variability of the images had to be implemented. For flooring, variability in the decorative laminate boards is an important sale feature. For example, in a floor of 50 square meters wherein the laminate floor boards were made using gravure printing about 7 identical laminate floor boards can be identified.

Therefore, there is still a need to have a decorative laminate manufacturing line which has minimal down-time due to inkjet printer defects, minimal waste through printing artefacts and a high variability in the manufactured laminate boards and all this at an economically acceptable cost.

SUMMARY OF THE INVENTION

It has been found that the problems described above can be overcome by using a plurality of multi-pass inkjet printers coupled to a single heating press. Preferred embodiments of the present invention have been realised with a decorative laminate manufacturing method as defined below.

By having 2, 3, 4 or more multi-pass inkjet printers, the down-time of the manufacturing line due to technical dysfunction of an inkjet printer could be eliminated. The availability of a plurality of multi-pass inkjet printers also allows adjusting the laminate manufacturing speed to market demand.

The failing nozzles issue was resolved by printing in at least two preferably four passes so that a line printing artefact was masked to a level that it was hardly visible in the image.

The slower printing speed of a multi-pass inkjet printer compared to a single pass inkjet printer resulted in no data streaming problems. A direct consequence of this is that maximum variability in the printed image could be implemented possible resulting in 50 $m^2$ floors having no or almost no identical laminate boards. Moreover this variability can be achieved with moderate computing power so that an economical benefit was obtained.

The multi-pass inkjet printers are equipped with a smaller number of print heads than the single pass inkjet printer which allows building a cheaper printer. For example, basing the printer cost only on the number of print heads which represents the most expensive part of an inkjet printer, four to five multi-pass inkjet printers having 64 print heads can be made for the cost of a single Hymmen Jupiter JPT-W printing contains 320 inkjet print heads without a decrease in throughput.

Further advantages and preferred embodiments of the present invention will become apparent from the following description.

DETAILED DESCRIPTION OF THE PREFERRED EMBODIMENTS

Methods of Manufacturing Decorative Laminates

Figure 1:
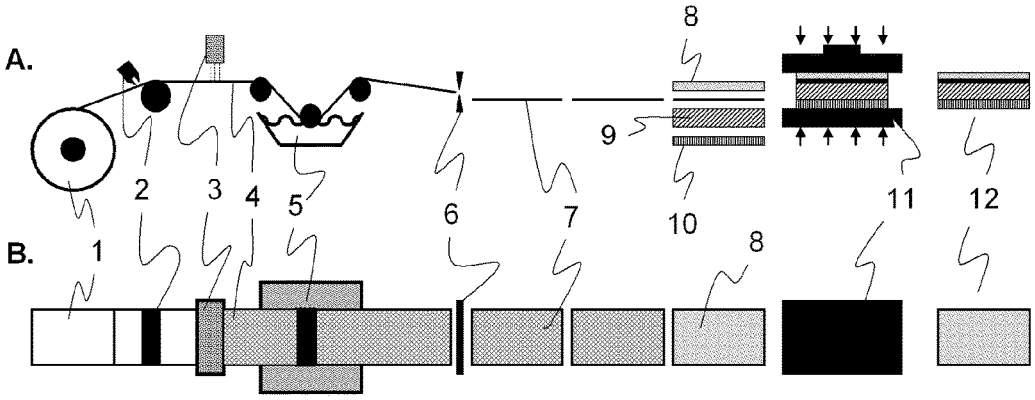
Prior Art Fig. 1
FIG. 1 is a schematic representation of a state-of-the-art decorative laminate manufacturing line, wherein A. shows a side view and B. shows a top view of the decorative laminate manufacturing line. A paper roll 1 is optionally coated with an ink acceptance layer by a coating head , then inkjet printed by a single pass inkjet printer 3 and thermosetting resin impregnated by passing through a thermosetting resin bath 5. The printed resin impregnated paper is then cut into a decorative layer 7 by a cutter 6 and combined with a protective layer 8, a core layer 9 and a balancing layer 10 into a layer assembly which is pressed into a decorative laminate 12 by a heating press 11.

The method of manufacturing decorative laminates according to a preferred embodiment of the present invention includes the steps of a) inkjet printing a first decorative layer 7 by a first multi-pass inkjet printer 13 and delivering the inkjet printed first decorative layer 7 to a laminate heating press 11 where it is heat pressed into a decorative laminate; and b) inkjet printing a second decorative layer 7 by a second multi-pass inkjet printer 13 and delivering the inkjet printed second decorative layer 7 to the same laminate heating press 11 where it is heat pressed into a decorative laminate.

In a preferred embodiment of the manufacturing method, a third decorative layer is inkjet printed by a third multi-pass inkjet printer and the inkjet printed third decorative layer is delivered to the same laminate heating press where it is heat pressed into a decorative laminate. In such a system, for maximum productivity, the paper sheets are consecutively supplied to the first, second and third multi-pass inkjet printer.

The inkjet printing is preferably performed on a thermosetting resin impregnated paper substrate or on an ink acceptance layer present on the surface of a thermosetting resin impregnated paper substrate. The advantage of having an ink acceptance layer for UV curable inkjet printing is that less ink lay down is required to obtain the same colour density as without the ink acceptance layer, thereby allowing better adhesion. The UV cured ink layer acts as a barrier layer for the water vapour produced during the heat pressing of the laminate. For water and solvent based inkjet inks, the ink acceptance layer improves the image quality due to less bleeding.

The inkjet printed ink on the thermosetting resin impregnated paper substrate is preferably a pigmented UV curable inkjet ink or a water-based resin ink, while the inkjet printed ink on the ink acceptance layer is preferably a pigmented aqueous inkjet ink.

The inkjet printed decorative layers printed on the first and second multi-pass inkjet printer preferably have a different colour pattern. This allows for a very high variability, resulting in no or few identical laminate in a floor.

The multi-pass inkjet printers are preferably a two to four pass inkjet printer. With less than two passes, printing artefacts from failing nozzles are not masked. While more than four passes slows down manufacturing or requires an uneconomical number of multi-pass inkjet printers.

The multi-pass inkjet printers preferably contain 8 to 64 piezoelectric print heads, more preferably 16 to 48 piezoelectric print heads and most preferably 32 piezoelectric print heads. With less than 8 piezoelectric print heads, the manufacturing speed is reduced or an uneconomical number of multi-pass inkjet printers are required. Preferably 2 to 6, more preferably 3 to 5, and most preferably 4 multi-pass inkjet printers are used. The multi-pass inkjet printers have preferably a through-put of at least 1,000 $m^2/h$, more preferably a through-put of at least 1,400 $m^2/h$, and most preferably a through-put of at least 1,700 $m^2/h$.

The paper substrates may be white or coloured. The coloured substrate can be a grey coloured paper substrate, allowing a reduction in the required amount of colour inkjet ink to be printed. This is known as so-called under colour removal technique. Preferably the coloured paper substrates are selected based on the colour pattern to be printed, e.g. a beige or light brown paper substrate for a colour pattern representing oak wood. Such an approach not only allows a reduction in the required inkjet ink, but also has the advantage of a better masking of printing artefacts.

In a preferred embodiment, differently coloured paper substrates, e.g. a white and pale beige paper substrate, or paper substrates having differently coloured ink acceptance layers, e.g. white paper substrates having a colourless and a pale beige ink acceptance layer are used for the first and second decorative layers. This allows increasing variability in the output of the decorative laminate manufacturing line of consecutive decorative laminates.

Decorative Laminate Manufacturing Lines

Figure 2:
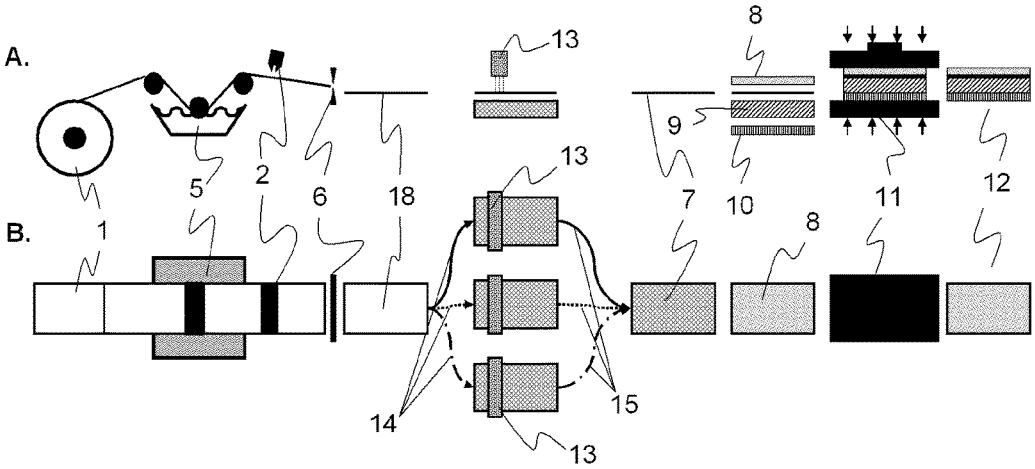
FIG. 2 is a schematic representation of a preferred set-up of a decorative laminate manufacturing line, wherein A. shows a side view and B. shows a top view of the decorative laminate manufacturing line. A paper roll 1 is thermosetting resin impregnated by passing through a thermosetting resin bath 5. After drying, an ink acceptance layer is applied by a coating head 2 and then cut into an unprinted resin impregnated paper sheet 18 by a cutter 6. The unprinted resin impregnated paper sheet 18 is supplied by a transport system 14 to a multi-pass inkjet printer 13. After inkjet printing, the decorative layer 7 is combined with a protective layer 8, a core layer 9 and a balancing layer 10 into a layer assembly which is supplied by a transport system 15 to a heating press 11, where it is pressed into a decorative laminate 12.
Figure 3:
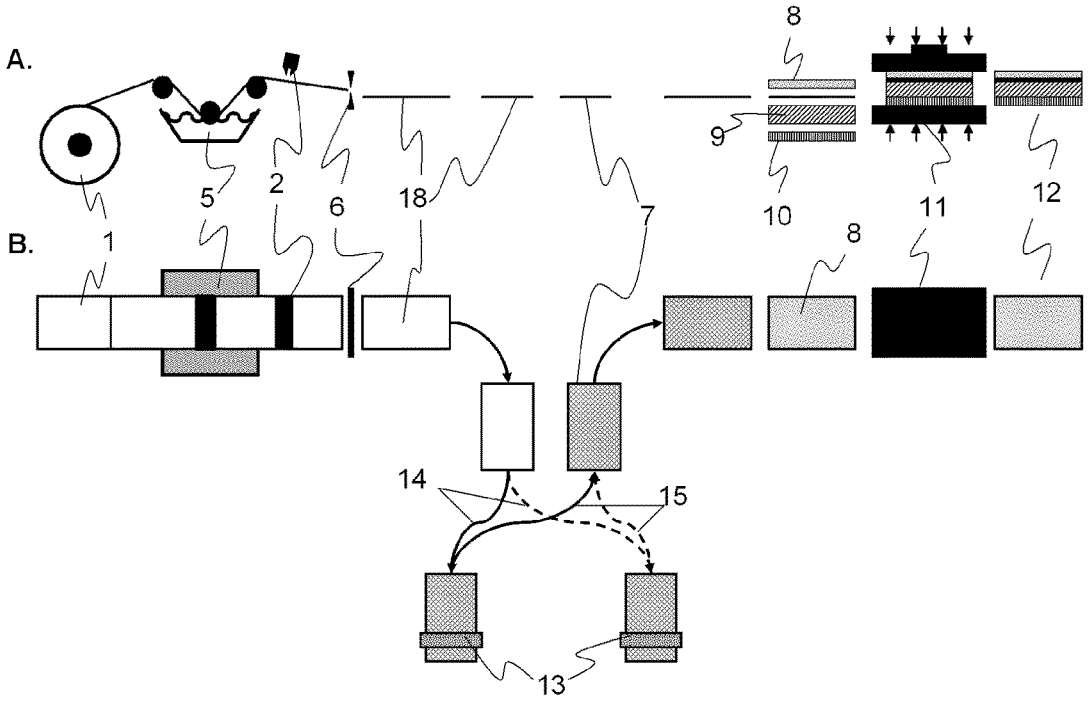
FIG. 3 is a schematic representation of a set-up of a decorative laminate manufacturing line which slightly differs from the set-up in FIG. 2 having three multi-pass inkjet printers 13.

The decorative laminate manufacturing line according to a preferred embodiment of the invention includes, in order, two or more multi-pass inkjet printers and a laminate heating press. Examples of such a decorative laminate manufacturing line are shown in FIGS. 2 and 3.

The decorative laminate manufacturing line preferably includes, in order, a thermosetting resin impregnating bath, the two or more multi-pass inkjet printers and the laminate heating press. Thermosetting resin impregnating baths and the transport of a paper web through such a bath are well-known in the art as exemplified by WO 2012/126816 (VITS) and EP 966641 A (VITS).

The decorative laminate manufacturing line preferably includes a transporting system for sheets. Such an automation of transport allows a high productivity. The transport system supplies paper sheets, preferably thermosetting resin impregnated paper sheets, to the plurality of multi-pass inkjet printers wherein two consecutive paper sheets are not delivered to the same multi-pass inkjet printer as this would slow down manufacturing speed.

The inkjet inks are jetted by a plurality of print heads ejecting small droplets in a controlled manner through nozzles onto the paper substrate or ink acceptance layer, which is moving relative to the print head(s).

There is no real restriction on the type of print head for the inkjet printing system, but preferably the print head is a piezoelectric head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head.

The inkjet print head normally scans back and forth in a transversal direction across the moving ink-receiver surface. Often an inkjet print head does not print on the way back.

Bi-directional printing is preferred for obtaining a high throughput in the decorative laminate manufacturing line.

After printing aqueous or solvent based inkjet inks, preferably a drying step is included. Drying may be performed in any desirable way, such as hot air blowers or infrared dryers.

If the inkjet inks used are UV curable inkjet inks, then a device is present for emitting UV light. The curing means may be arranged in combination with the print head of the inkjet printer, travelling therewith so that the curing radiation is applied very shortly after jetting. Such rapid curing is sometimes referred to as "pin curing" and used for enhancing image quality by controlling the dot size. Preferably such curing means consists of one or more UV LEDs.

Any ultraviolet light source, as long as part of the emitted light can be absorbed by the photo-initiator or photo-initiator system, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

In a preferred embodiment, the inkjet printing device contains one or more UV LEDs with a wavelength larger than 360 nm, preferably one or more UV LEDs with a wavelength larger than 380 nm, and most preferably UV LEDs with a wavelength of about 390 nm.

Furthermore, it is possible to cure the image using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages such as a fast curing speed and a high curing degree.

Decorative Laminates

The decorative laminates are preferably rigid or flexible panels, but may also be rolls of a flexible substrate. In a preferred embodiment the decorative laminates are selected from the group consisting of kitchen panels, flooring panels, furniture panels, ceiling panels and wall panels.

Figure 4:
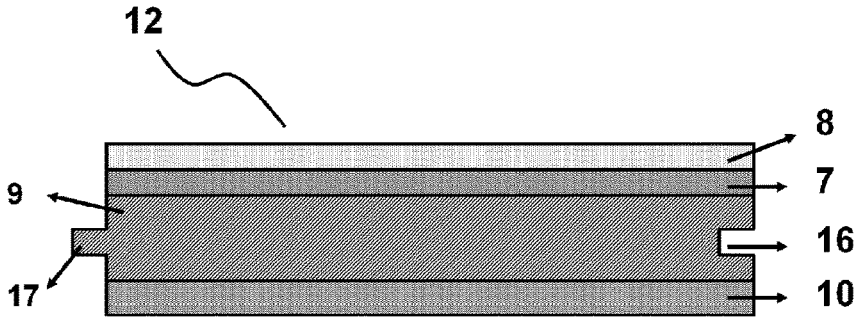
FIG. 4 shows a cross-section of a decorative laminate 12 including a core layer 9 with a groove 16 and tongue 17 which is laminated on the top side by a decorative layer 7 and a protective layer 8 and on the back side by a balancing layer 10.
Figure 5:
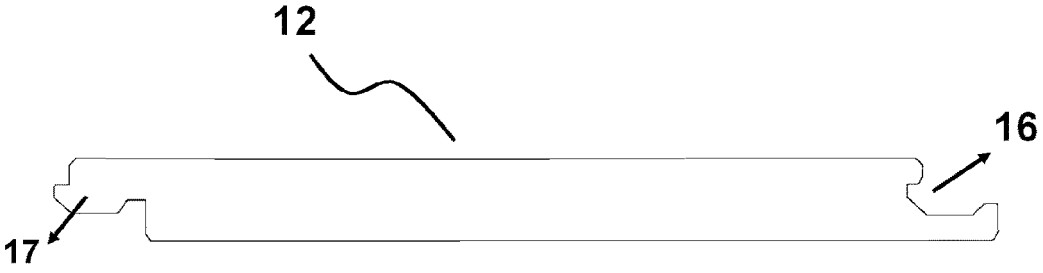
FIG. 5 shows a cross section of a decorative laminate 12 having a mechanical joint by a tongue 17 and a groove 16 requiring no glue.

A decorative laminate 12, illustrated by a flooring panel having also a tongue and groove joint (17, 16) in FIG. 4, includes preferably at least a core layer 9 and a decorative layer 7. In order to protect the colour pattern of the decorative layer 7 against wear, a protective layer 8 may be applied on top of the decorative layer 7. A balancing layer 10 may also be applied at the opposite side of the core layer 9 to restrict or prevent possible bending of the decorative laminate. The assembly into a decorative laminate of the balancing layer, the core layer, the decorative layer, and preferably also a protective layer, is preferably performed in the same press treatment of preferably a DPL process (Direct Pressure Laminate).

In a preferred embodiment of decorative laminates, tongue and groove profiles (17 respectively 16 in FIG. 4) are milled into the side of individual decorative laminates which allow them to be slid into one another. The tongue and grove joint ensures, in the case of flooring laminates, a sturdy floor construction and protects the floor, preventing dampness from penetrating.

In a more preferred embodiment, the decorative laminates include a tongue and a groove of a special shape (e.g. 17 respectively 16 in FIG. 4) which allow them to be clicked into one another. The advantage thereof is an easy assembly requiring no glue. The shape of the tongue and groove necessary for obtaining a good mechanical joint is well-known in the art of laminate flooring, as also exemplified in EP 2280130 A (FLOORING IND), WO 2004/053258 (FLOORING IND), US 2008010937 (VALINGE) and U.S. Pat. No. 6,418,683 (PERSTORP FLOORING).

The tongue and groove profiles are especially preferred for flooring laminates and wall laminates, but in the case of furniture laminates, such tongue and groove profile is preferably absent for aesthetical reasons of the furniture doors and drawer fronts. However, a tongue and groove profile may be used to click together the other laminates of the furniture, as illustrated by US 2013071172 (UNILIN).

The decorative laminates may further include a sound-absorbing layer as disclosed by U.S. Pat. No. 8,196,366 (UNILIN).

In a preferred embodiment, the decorative laminate is an antistatic layered panel. Techniques to render decorative laminates antistatic are well-known in the art of decorative surfaces as exemplified by EP 1567334 A (FLOORING IND).

The top surface of the decorative surface, i.e. at least the protective layer, is preferably provided with a relief matching the colour pattern, such as for example the wood grain, cracks and nuts in a woodprint. Embossing techniques to accomplish such relief are well-known and disclosed by, for example, EP 1290290 A (FLOORING IND), US 2006144004 (UNILIN), EP 1711353 A (FLOORING IND) and US 2010192793 (FLOORING IND).

In a preferred embodiment, the decorative laminates are made in the form of rectangular oblong strips. The dimensions thereof may vary greatly. Preferably the laminates have a length exceeding 1 meter, and a width exceeding 0.1 meter, e.g. the laminates can be about 1.3 meter long and about 0.15 meter wide. According to a special preferred embodiment the length of the laminates exceeds 2 meter, with the width being preferably about 0.2 meter or more. The print of such laminates is preferably free from repetitions.

Core Layers

The core layer is preferably made of wood-based materials, such as particle board, MDF or HDF (Medium Density Fibreboard or High Density Fibreboard), Oriented Strand Board (OSB) or the like. Also, use can be made of boards of synthetic material or boards hardened by means of water, such as cement boards. In a particularly preferred embodiment, the core layer is a MDF or HDF board.

The core layer may also be assembled at least from a plurality of paper sheets, or other carrier sheets, impregnated with a thermosetting resin as disclosed by WO 2013/050910 (UNILIN). Preferred paper sheets include so-called Kraft paper obtained by a chemical pulping process also known as the Kraft process, e.g. as described in U.S. Pat. No. 4,952,277 (BET PAPERCHEM).

In another preferred embodiment, the core layer is a board material composed substantially of wood fibres which are bonded by means of a polycondensation glue, wherein the polycondensation glue forms 5 to 20 percent by weight of the board material and the wood fibres are obtained for at least 40 percent by weight from recycled wood. Suitable examples are disclosed by EP 2374588 A (UNILIN).

Instead of a wood based core layer, also a synthetic core layer may be used, such as those disclosed by US 2013062006 (FLOORING IND). In a preferred embodiment, the core layer comprises a foamed synthetic material, such as foamed polyethylene or foamed polyvinyl chloride.

Other preferred core layers and their manufacturing are disclosed by US 2011311806 (UNILIN) and U.S. Pat. No. 6,773,799 (DECORATIVE SURFACES).

The thickness of the core layer is preferably between 2 and 12 mm, more preferably between 5 and 10 mm.

Paper Substrates

The decorative layer and preferably, if present, also the protective layer and/or balancing layer, include paper as substrate.

The paper preferably has a weight of less than 150 g/m$^2$, because heavier paper sheets are hard to impregnate all through their thickness with a thermosetting resin. Preferably said paper layer has a paper weight, i.e. without taking into account the resin provided on it, of between 50 and 100 g/m$^2$ and possibly up to 130 g/m$^2$. The weight of the paper cannot be too high, as then the amount of resin needed to sufficiently impregnate the paper would be too high, and reliably further processing the printed paper in a pressing operation becomes badly feasible.

Preferably, the paper sheets have a porosity according to Gurley's method (DIN 53120) of between 8 and 20 seconds. Such porosity allows even for a heavy sheet of more than 150 g/m$^2$ to be readily impregnated with a relatively high amount of resin.

Suitable paper sheets having high porosity and their manufacturing are also disclosed by U.S. Pat. No. 6,709,764 (ARJO WIGGINS).

The paper for the decorative layer is preferably a white paper and may include one or more whitening agents, such as titanium dioxide, calcium carbonate and the like. The presence of a whitening agent helps to mask differences in colour on the core layer which can cause undesired colour effects on the colour pattern.

Alternatively, the paper for the decorative layer is preferably a bulk coloured paper including one or more colour dyes and/or colour pigments. Besides the masking of differences in colour on the core layer, the use of a coloured paper reduces the amount of inkjet ink required to print the colour pattern. For example, a light brown or grey paper may be used for printing a wood motif as colour pattern in order to reduce the amount of inkjet ink needed.

In a preferred embodiment, unbleached Kraft paper is used for a brownish coloured paper in the decorative layer. Kraft paper has a low lignin content resulting in a high tensile strength. A preferred type of Kraft paper is absorbent Kraft paper of 40 to 135 g/m$^2$ having a high porosity and made from clean low kappa hardwood Kraft of good uniformity.

If the protective layer includes a paper, then a paper is used which becomes transparent or translucent after resin impregnation so that the colour pattern in the decorative layer can be viewed through the protective layer.

The above papers may also be used in the balancing layer.

Thermosetting Resins

The thermosetting resin is preferably selected from the group consisting of melamine-formaldehyde based resins, ureum-formaldehyde based resins and phenol-formaldehyde based resins.

Other suitable resins for impregnating the paper are listed in [0028] of EP 2274485 A (HUELSTA).

Most preferably the thermosetting resin is a melamine-formaldehyde based resin, often simply referred to in the art as a 'melamine (based) resin'.

The melamine formaldehyde resin preferably has a formaldehyde to melamine ratio of 1.4 to 2. Such melamine based resin is a resin that polycondensates while exposed to heat in a pressing operation. The polycondensation reaction creates water as a by-product. It is particularly with these kinds of thermosetting resins, namely those creating water as a by-product, that the present invention is of interest. The created water, as well as any water residue in the thermosetting resin before the pressing, must leave the hardening resin layer to a large extent before being trapped and leading to a loss of transparency in the hardened layer.

The paper is preferably provided with an amount of thermosetting resin equaling 40 to 250% dry weight of resin as compared to weight of the paper. Experiments have shown that this range of applied resin provides for a sufficient impregnation of the paper, that avoids splitting to a large extent, and that stabilizes the dimension of the paper to a high degree.

The paper is preferably provided with such an amount of thermosetting resin, that at least the paper core is satisfied with the resin. Such satisfaction can be reached when an amount of resin is provided that corresponds to at least 1.5 or at least 2 times the paper weight. Preferably the paper is firstly impregnated through or satisfied, and, afterwards, at least at the side thereof to be printed, resin is partially removed.

Preferably the resin provided on said paper is in a B-stage while printing. Such B-stage exists when the thermosetting resin is not completely cross linked.

Preferably the resin provided on said paper has a relative humidity lower than 15%, and still better of 10% by weight or lower while printing.

Preferably the step of providing said paper with thermosetting resin involves applying a mixture of water and the resin on the paper. The application of the mixture might involve immersion of the paper in a bath of the mixture and/or spraying or jetting the mixture. Preferably the resin is provided in a dosed manner, for example by using one or more squeezing rollers and/or doctor blades to set the amount of resin added to the paper layer.

Methods for impregnating a paper substrate with resin are well-known in the art as exemplified by WO 2012/126816 (VITS) and EP 966641 A (VITS).

The dry resin content of the mixture of water and resin for impregnation depends on the type of resin. An aqueous solution containing a phenol-formaldehyde resin preferably has a dry resin content of about 30% by weight, while an aqueous solution containing a melamine-formaldehyde resin preferably has a dry resin content of about 60% by weight. Methods of impregnation with such solutions are disclosed by e.g. U.S. Pat. No. 6,773,799 (DECORATIVE SURFACES).

The paper is preferably impregnated with the mixtures known from U.S. Pat. No. 4,109,043 (FORMICA CORP) and U.S. Pat. No. 4,112,169 (FORMICA CORP), and hence preferably comprise, next to melamine formaldehyde resin, also polyurethane resin and/or acrylic resin.

The mixture including the thermosetting resin may further include additives, such as colorants, surface active ingredients, biocides, antistatic agents, hard particles for wear resistance, elastomers, UV absorbers, adhesion promotors, organic solvents, acids, bases, and the like.

The advantage of adding a colorant to the mixture containing the thermosetting resin is that a single type of white paper can be used for manufacturing the decorative layer, thereby reducing the stock of paper for the decorative laminate manufacturer. The use of a coloured paper, as already described above, to reduce the amount of ink required for printing a wood motif, is here accomplished by the white paper being coloured by impregnation by a brownish thermosetting resin. The latter allows a better control of the amount of brown colour required for certain wood motifs.

Antistatic agents may be used in thermosetting resin. However preferably antistatic agents, like NaCl and KCl, carbon particles and metal particles, are absent in the resin, because often they have undesired side effects such as a lower water resistance or a lower transparency. Other suitable antistatic agents are disclosed by EP 1567334 A (FLOORING IND).

Hard particles for wear resistance are preferably included in a protective layer.

Decorative Layers

The decorative layer includes a paper substrate, preferably a thermosetting resin impregnated paper, and a colour pattern printed thereon by inkjet. In the assembled decorative laminate, the colour pattern is located on the resin impregnated paper on the opposite side than the side facing the core layer.

Before printing a colour pattern, or at least a portion thereof, the paper has preferably been provided with thermosetting resin. This measure improves the stability of the paper. In such cases at least a portion of the expansion or shrinkage due to the resin provision takes place before inkjet printing. Preferably the resin provided paper is dried before inkjet printing, for example to a residual humidity of 10% or less. In this case the most important portion of the expansion or shrinkage of the paper layer is neutralized. The advantage of having this dimensional stability is especially observed in the cases where, like in EP 1290290 A (FLOORING IND), a correspondence between the embossed relief and the printed decor is desired.

A decorative laminate, like a floor panel, has on one side of the core layer a decorative layer and a balancing layer on the other side of the core layer. However, a decorative layer may be applied on both sides of the core layer. The latter is especially desirable in the case of laminates for furniture. In such a case, preferably also a protective layer is applied on both decorative layers present on both sides of the core layer.

Ink Acceptance Layers

An ink acceptance layer is preferably present on the surface of a paper substrate, more preferably thermosetting resin impregnated paper substrate, especially when printing with aqueous inkjet inks and/or solvent inkjet inks.

In a preferred embodiment, the ink acceptance layer includes a polymer, preferably a water soluble (>1 g/L water) which has a hydroxyl group as a hydrophilic structural unit, e.g. polyvinyl alcohol.

In a preferred embodiment, the ink acceptance layer includes a polymer selected from the group consisting of hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinyl acetal; polyvinyl pyrrolidone; polyacrylamide; acrylamide/acrylic acid copolymer; polystyrene, styrene copolymers; acrylic or methacrylic polymers; styrene/acrylic copolymers; ethylene-vinylacetate copolymer; vinyl-methyl ether/maleic acid copolymer; poly (2-acrylamido-2-methyl propane sulfonic acid); poly(diethylene triamine-co-adipic acid); polyvinyl pyridine; polyvinyl imidazole; polyethylene imine epichlorohydrin modified; polyethylene imine ethoxylated; ether bond-containing polymers such as polyethylene oxide (PEO), polypropylene oxide (PPO), polyethylene glycol (PEG) and polyvinyl ether (PVE); polyurethane; melamine resins; gelatin; carrageenan; dextran; gum arabic; casein; pectin; albumin; chitins; chitosans; starch; collagen derivatives; collodion and agar-agar.

A preferred polymer for the ink acceptance layer is a polyvinylalcohol (PVA), a vinylalcohol copolymer or modified polyvinyl alcohol. The modified polyvinyl alcohol may be a cationic type polyvinyl alcohol, such as the cationic polyvinyl alcohol grades from Kuraray, such as POVAL C506, POVAL C118 from Nippon Goshei.

The ink acceptance layer preferably further includes a pigment, more preferably an inorganic pigment and most preferably a porous inorganic pigment. Mixtures of two or more pigments may be used. For reasons of image quality, the particle size of the pigment should preferably be smaller than 500 nm.

The pigment used is preferably an inorganic pigment, which can be chosen from neutral, anionic and cationic pigment types. Useful pigments include e.g. silica, talc, clay, hydrotalcite, kaolin, diatomaceous earth, calcium carbonate, magnesium carbonate, basic magnesium carbonate, aluminosilicate, aluminum trihydroxide, aluminum oxide (alumina), titanium oxide, zinc oxide, barium sulfate, calcium sulfate, zinc sulfide, satin white, alumina hydrate such as boehmite, zirconium oxide or mixed oxides.

The inorganic pigment is preferably selected from the group consisting of alumina hydrates, aluminum oxides, aluminum hydroxides, aluminum silicates, and silicas.

Particularly preferred inorganic pigments are silica particles, colloidal silica, alumina particles and pseudo-boehmite, as they form better porous structures. When used herein, the particles may be primary particles directly used as they are, or they may form secondary particles. Preferably, the particles have an average primary particle diameter of 2 pm or less, and more preferably 200 nm or less.

A preferred type of alumina hydrate is crystalline boehmite, or λ-AlO(OH). Useful types of boehmite include DISPERAL HP14, DISPERAL 40, DISPAL 23N4-20, DISPAL 14N-25 and DISPERAL AL25 from Sasol; and MARTOXIN VPP2000-2 and GL-3 from Martinswerk GmbH Useful cationic aluminum oxide (alumina) types include $\alpha$-$Al_2O_3$ types, such as NORTON E700, available from Saint-Gobain Ceramics & Plastics, Inc, and $\lambda$-$Al_2O_3$ types, such as ALUMINUM OXID C from Degussa.

Other useful inorganic pigments include aluminum trihydroxides such as Bayerite, or $\alpha$-$Al(OH)_3$, such as PLURAL BT, available from Sasol, and Gibbsite, or $\lambda$-$Al(OH)_3$, such as MARTINAL grades and MARTIFIN grades from Martinswerk GmbH, MICRAL grades from JM Huber company; HIGILITE grades from Showa Denka K.K.

Another preferred type of inorganic pigment is silica which can be used as such, in its anionic form or after cationic modification. The silica can be chosen from different types, such as crystalline silica, amorphous silica, precipitated silica, fumed silica, silica gel, spherical and non-spherical silica. The silica may contain minor amounts of metal oxides from the group Al, Zr, Ti. Useful types include AEROSIL OX50 (BET surface area 50±15 $m^2/g$, average primary particle size 40 nm, $SiO_2$ content>99.8%, $Al_2O_3$ content<0.08%), AEROSIL MOX170 (BET surface area 170 $g/m^2$, average primary particle size 15 nm, $SiO_2$ content>98.3%, $Al_2O_3$ content 0.3-1.3%), AEROSIL MOX80 (BET surface area 80±20 g/m$^2$, average primary particle size 30 nm, $SiO_2$ content>98.3%, $Al_2O_3$ content 0.3-1.3%), or other hydrophilic AEROSIL grades available from Degussa-Hüls AG, which may give aqueous dispersions with a small average particle size (<500 nm).

Generally depending on their production method, silica particles are grouped into two types, wet-process particles and dry-process (vapour phase-process or fumed) particles.

In the wet process, active silica is formed through acidolysis of silicates, and this is polymerized to a suitable degree and flocculated to obtain hydrous silica.

A vapour-phase process includes two types; one includes high-temperature vapour-phase hydrolysis of silicon halide to obtain anhydrous silica (flame hydrolysis), and the other includes thermal reduction vaporization of silica sand and coke in an electric furnace followed by oxidizing it in air to also obtain anhydrous silica (arc process). The "fumed silica" means to indicate anhydrous silica particles obtained in the vapour-phase process.

For the silica particles used in the invention, especially preferred are the fumed silica particles. The fumed silica differs from hydrous silica in point of the density of the surface silanol group and of the presence or absence of pores therein, and the two different types of silica have different properties. The fumed silica is suitable for forming a three-dimensional structure of high porosity. Since the fumed silica has a particularly large specific surface area, its ink absorption and retention are high. Preferably, the vapour-phase silica has an average primary particle diameter of 30 nm or less, more preferably 20 nm or less, even more preferably 10 nm or less, and most preferably from 3 to 10 nm. The fumed silica particles readily aggregate through hydrogen bonding at the silanol groups therein. Therefore, when their mean primary particle size is not larger than 30 nm, the silica particles may form a structure of high porosity, and effectively increase the ink absorbability of the layer containing them.

Organic pigments may be chosen from polystyrene, polymethyl methacrylate, melamine-formaldehyde condensation polymers, urea-formaldehyde condensation polymers, polyesters and polyamides. Mixtures of inorganic and organic pigments can be used. However, most preferably the pigment is an inorganic pigment.

For fast ink uptake, the pigment/polymer ratio in the ink acceptance layer is preferably at least 2, 3 or 4. To achieve a sufficient porosity for fast ink uptake the pore volume of these pigmented ink acceptance layers should be higher than 0.1 ml/g solids of the ink acceptance layer. This pore volume can be measured by gas adsorption (nitrogen) or by mercury diffusion.

Colour Patterns

The colour pattern is obtained by jetting inkjet inks on a thermosetting resin impregnated paper substrate, e.g. UV curable inkjet inks, or on an ink acceptance layer present on the surface of a thermosetting resin impregnated paper substrate. Aqueous inkjet inks of an aqueous inkjet ink set are preferably printed on an ink acceptance layer present on the surface of a thermosetting resin. The colour pattern represents preferably less than 5 g/m$^2$ ink, more preferably between 0.5 and 4.0 g/m$^2$ ink as dry weight.

There is no real restriction on the content of the colour pattern. The colour pattern may also contain information such as text, arrows, logo's and the like. The advantage of inkjet printing is that such information can be printed at low volume without extra cost, contrary to gravure printing.

In a preferred embodiment, the colour pattern is a wood reproduction or a stone reproduction, but it may also be a fantasy or creative pattern, such as an ancient world map or a geometrical pattern, or even a single colour for making, for example, a floor consisting of black and red tiles or a single colour furniture door.

An advantage of printing a wood colour pattern is that a floor can be manufactured imitating besides oak, pine and beech, also very expensive wood like black walnut which would normally not be available for house decoration.

An advantage of printing a stone colour pattern is that a floor can be manufactured which is an exact imitation of a stone floor, but without the cold feeling when walking barefooted on it and that it is easy replaceable over time according to fashion.

Protective Layers

Preferably a protective layer is applied after printing above the colour pattern, e.g. by way of an overlay, i.e. a resin provided carrier, or a liquid coating, preferably while the decor layer is laying on the substrate, either loosely or already connected or adhered thereto.

In a preferred embodiment, the carrier of the overlay is a paper impregnated by a thermosetting resin that becomes transparent or translucent after heat pressing in a DPL process.

A preferred method for manufacturing such an overlay is described in US 2009208646 (DEKOR KUNSTSTOFFE).

The liquid coating includes preferably a thermosetting resin, but may also be another type of liquid such as a UV- or an EB-curable varnish.

In a particularly preferred embodiment, the liquid coating includes a melamine resin and hard particles, like corundum.

The protective layer is preferably the outermost layer, but in another preferred embodiment a thermoplastic or elastomeric surface layer may be coated on the protective layer, preferably of pure thermoplastic or elastomeric material. In the latter case, preferably a thermoplastic or elastomeric material based layer is also applied on the other side of the core layer.

Liquid melamine coatings are exemplified in DE 19725829 C (LS INDUSTRIELACKE) and U.S. Pat. No. 3,173,804 (RENKL PAIDIWERK).

The liquid coating may contain hard particles, preferably transparent hard particles. Suitable liquid coatings for wear protection containing hard particles and methods for manufacturing such a protective layer are disclosed by US 2011300372 (CT FOR ABRASIVES AND REFRACTORIES) and U.S. Pat. No. 8,410,209 (CT FOR ABRASIVES AND REFRACTORIES).

The transparency and also the colour of the protective layer can be controlled by the hard particles, when they comprise one or a plurality of oxides, oxide nitrides or mixed oxides from the group of elements Li, Na, K, Ca, Mg, Ba, Sr, Zn, Al, Si, Ti, Nb, La, Y, Ce or B.

The total quantity of hard particles and transparent solid material particles is typically between 5% by volume and 70% by volume, based on the total volume of the liquid coating. The total quantity of hard particles is between 1 g/m$^2$ and 100 g/m$^2$, preferably 2 g/m$^2$ to 50 g/m$^2$.

If the protective layer includes a paper as carrier sheet for the thermosetting resin, then the hard particles, such as aluminium oxide particles, are preferably incorporated in or on the paper. Preferred hard particles are ceramic or mineral particles chosen from the group of aluminium oxide, silicon carbide, silicon oxide, silicon nitride, tungsten carbide, boron carbide, and titanium dioxide, or from any other metal oxide, metal carbide, metal nitride or metal carbonitride. The most preferred hard particles are corundum and so-called Sialon ceramics. In principle, a variety of particles may be used. Of course, also any mixture of the above-mentioned hard particles may be applied.

In an alternative preferred embodiment of a protective layer including a paper as carrier sheet for the thermosetting resin, the inkjet printing is performed on the thermosetting resin impregnated paper of the protective layer. The other paper substrate including a whitening agent, such as titanium dioxide, may then merely be used to mask surface defects of the core layer.

The amount of hard particles in the protective layer may determined in function of the desired wear resistance, preferably by a so-called Taber test as defined in EN 13329 and also disclosed in WO 2013/050910 A (UNILIN) and U.S. Pat. No. 8,410,209 (CT FOR ABRASIVES AND REFRACTOR) .

Hard particles having an average particle size of between 1 and 200 μm are preferred. Preferably an amount of such particles of between 1 and 40 g/m$^2$ is applied above the printed pattern. An amount lower than 20 g/m$^2$ can suffice for the lower qualities.

If the protective layer includes a paper, then it preferably has a paper weight of between 10 and 50 g/m$^2$. Such a paper is often also referred to as a so-called overlay commonly used in laminate panels. Preferred methods for manufacturing such an overlay are disclosed by WO 2007/144718 (FLOORING IND).

Preferably the step of providing the protective layer of thermosetting resin above the printed pattern involves a press treatment. Preferably a temperature above 150° C. is applied in the press treatment, more preferably between 180° and 220° C., and a pressure of more than 20 bar, more preferably between 35 and 40 bar.

In a very preferred embodiment, the decorative panel is manufactured using two press treatments, because this results in an extremely high abrasion resistance. Indeed, during the first press treatment, preferably the layers immediately underlying the wear resistant protective layer are substantially or wholly cured. The hard particles comprised in the wear resistant protective layer are thereby prevented from being pushed down out of the top area of the floor panel into the colour pattern or below the colour pattern and stay in the zone where they are most effective, namely essentially above the colour pattern. This makes it possible to reach an initial wear point according to the Taber test as defined in EN 13329 of over 10000 rounds, where in one press treatment of layers with the same composition only just over 4000 rounds were reached. It is clear that the use of two press treatments as defined above, leads to a more effective use of available hard particles. An alternative advantage of using at least two press treatments lays in the fact that a similar wearing rate, as in the case where a single press treatment is used, can be obtained with less hard particles if the product is pressed twice. Lowering the amount of hard particles is interesting, since hard particles tend to lower the transparency of the wear resistant protective layer, which is undesirable. It becomes also possible to work with hard particles of smaller diameter, e.g. particles having an average particle diameter of 15 μm or less, or even of 5 μm or less.

Balancing Layers

The main purpose of the balancing layer(s) is to compensate tensile forces by layers on the opposite side of the core layer, so that an essentially flat decorative panel is obtained. Such a balancing layer is preferably a thermosetting resin layer, that can comprise one or more carrier layers, such as paper sheets.

As already explained above for a furniture panel, the balancing layer(s) may be a decorative layer, optionally complemented by a protective layer.

Instead of one or more transparent balancing layers, also an opaque balancing layer may be used which gives the decorative panel a more appealing look by masking surface irregularities. Additionally, it may contain text or graphical information such as a company logo or text information Inkjet Inks The inkjet inks are preferably selected from the group consisting of aqueous inkjet inks, solvent based inkjet inks and UV curable inkjet inks. Most preferably the inkjet inks are aqueous inkjet inks.

The inkjet inks are preferably pigmented inkjet inks. An aqueous inkjet ink preferably includes at least a colour pigment and water, more preferably completed with one or more organic solvents such as humectants, and a dispersant if the colour pigment is not a self-dispersible colour pigment.

A UV curable inkjet ink preferably includes at least a colour pigment, a polymeric dispersant, a photoinitiator and a polymerizable compound, such as a monomer or oligomer.

The inkjet inks are composed into a inkjet ink set having differently coloured inkjet inks. The inkjet ink set may be a standard CMYK ink set, but is preferably a CRYK ink set wherein the magenta (M) ink is replaced by red (R) inkjet ink. The use of a red inkjet ink enhances the colour gamut for wood based colour patterns, which represent the majority of decorative laminates in flooring laminates.

The inkjet ink set may be extended with extra inks such as white, brown, red, green, blue, and/or orange to further enlarge the colour gamut of the image. The inkjet ink set may also be extended by the combination of the full density inkjet inks with light density inkjet inks. The combination of dark and light colour inks and/or black and grey inks improves the image quality by a lowered graininess. However preferably the inkjet ink set consists of no more than 3 or 4 inkjet inks, allowing the design of multi-pass inkjet printers of high throughput at acceptable cost.

Colorants

The colorant in an inkjet ink can be a dye, but is preferably a colour pigment. The pigmented inkjet ink preferably contains a dispersant, more preferably a polymeric dispersant, for dispersing the pigment. In addition to the polymeric dispersant, the pigmented inkjet ink may contain a dispersion synergist to further improve the dispersion quality and stability of the ink.

In a pigmented aqueous inkjet ink, the aqueous inkjet ink may contain a so-called "self dispersible" colour pigment. A self-dispersible colour pigment requires no dispersant, because the pigment surface has ionic groups which realize electrostatic stabilization of the pigment dispersion. In case of self-dispersible colour pigments, the steric stabilization obtained by using a polymeric dispersant becomes optional. The preparation of self-dispersible colour pigments is well-known in the art and can be exemplified by EP 904327 A (CABOT).

The colour pigments may be black, white, cyan, magenta, yellow, red, orange, violet, blue, green, brown, mixtures thereof, and the like. A colour pigment may be chosen from those disclosed by HERBST, Willy, et al. Industrial Organic Pigments, Production, Properties, Applications. 3rd edition. Wiley-VCH, 2004. ISBN 3527305769.

A particularly preferred pigment for a cyan aqueous inkjet ink is a copper phthalocyanine pigment, more preferably C.I. Pigment Blue 15:3 or C.I. Pigment Blue 15:4.

Particularly preferred pigments for a red aqueous inkjet ink are C.I Pigment Red 254, C.I. Pigment Red 176 and C.I. Pigment Red 122, and mixed crystals thereof.

Particularly preferred pigments for yellow aqueous inkjet ink are C.I Pigment Yellow 151, C.I. Pigment Yellow 180 and C.I. Pigment Yellow 74, and mixed crystals thereof.

For the black ink, suitable pigment materials include carbon blacks such as Regal™ 400R, Mogul™ L, Elftex™ 320 from Cabot Co., or Carbon Black FW18, Special Black™ 250, Special Black™ 350, Special Black™ 550, Printex™ 25, Printex™ 35, Printex™ 55, Printex™ 90, Printex™ 150T from DEGUSSA Co., MA8 from MITSUBISHI CHEMICAL Co., and C.I. Pigment Black 7 and C.I. Pigment Black 11.

Also mixed crystals may be used. Mixed crystals are also referred to as solid solutions. For example, under certain conditions different quinacridones mix with each other to form solid solutions, which are quite different from both physical mixtures of the compounds and from the compounds themselves. In a solid solution, the molecules of the components enter into the same crystal lattice, usually, but not always, that of one of the components. The x-ray diffraction pattern of the resulting crystalline solid is characteristic of that solid and can be clearly differentiated from the pattern of a physical mixture of the same components in the same proportion. In such physical mixtures, the x-ray pattern of each of the components can be distinguished, and the disappearance of many of these lines is one of the criteria of the formation of solid solutions. A commercially available example is Cinquasia™ Magenta RT-355-D from Ciba Specialty Chemicals.

Also mixtures of pigments may be used. For example, the inkjet ink includes a carbon black pigment and at least one pigment selected from the group consisting of a blue pigment, a cyan pigment, magenta pigment and a red pigment. It was found that such a black inkjet ink allowed easier and better colour management for wood colours.

The pigment particles in the pigmented inkjet ink should be sufficiently small to permit free flow of the ink through the inkjet printing device, especially at the ejecting nozzles. It is also desirable to use small particles for maximum colour strength and to slow down sedimentation.

The average particle size of the pigment in the pigmented inkjet ink should be between 0.005 μm and 15 μm. Preferably, the average pigment particle size is between 0.005 and 5 μm, more preferably between 0.005 and 1 μm, particularly preferably between 0.005 and 0.3 μm and most preferably between 0.040 and 0.150 μm.

The pigment is used in the pigmented inkjet ink in an amount of 0.1 to 20 wt %, preferably 1 to 10 wt %, and most preferably 2 to 5 wt % based on the total weight of the pigmented inkjet ink. A pigment concentration of at least 2 wt % is preferred to reduce the amount of inkjet ink needed to produce the colour pattern, while a pigment concentration higher than 5 wt % reduces the colour gamut for printing the colour pattern with print heads having a nozzle diameter of 20 to 50 μm.

Dispersants

The pigmented inkjet ink may contain a dispersant, preferably a polymeric dispersant, for dispersing the pigment.

Suitable polymeric dispersants are copolymers of two monomers but they may contain three, four, five or even more monomers. The properties of polymeric dispersants depend on both the nature of the monomers and their distribution in the polymer. Copolymeric dispersants preferably have the following polymer compositions:

- statistically polymerized monomers (e.g. monomers A and B polymerized into ABBAABAB);
- alternating polymerized monomers (e.g. monomers A and B polymerized into ABABABAB);
- gradient (tapered) polymerized monomers (e.g. monomers A and B polymerized into AAABAABBABBB);
- block copolymers (e.g. monomers A and B polymerized into AAAAABBBBBB) wherein the block length of each of the blocks (2, 3, 4, 5 or even more) is important for the dispersion capability of the polymeric dispersant;
- graft copolymers (graft copolymers consist of a polymeric backbone with polymeric side chains attached to the backbone); and
- mixed forms of these polymers, e.g. blocky gradient copolymers.

Suitable dispersants are DISPERBYK™ dispersants available from BYK CHEMIE, JONCRYL™ dispersants available from JOHNSON POLYMERS and SOLSPERSE™ dispersants available from ZENECA. A detailed list of non-polymeric as well as some polymeric dispersants is disclosed by MC CUTCHEON. Functional Materials, North American Edition. Glen Rock, N.J.: Manufacturing Confectioner Publishing Co., 1990. p. 110-129.

The polymeric dispersant has preferably a number average molecular weight Mn between 500 and 30000, more preferably between 1500 and 10000.

The polymeric dispersant has preferably a weight average molecular weight Mw smaller than 100,000, more preferably smaller than 50,000 and most preferably smaller than 30,000.

In a particularly preferred embodiment, the polymeric dispersant used in an aqueous pigmented inkjet ink is a copolymer comprising between 3 and 11 mol % of a long aliphatic chain (meth)acrylate wherein the long aliphatic chain contains at least 10 carbon atoms.

The long aliphatic chain (meth)acrylate contains preferably 10 to 18 carbon atoms. The long aliphatic chain (meth)acrylate is preferably decyl (meth)acrylate. The polymeric dispersant can be prepared with a simple controlled polymerization of a mixture of monomers and/or oligomers including between 3 and 11 mol % of a long aliphatic chain (meth)acrylate wherein the long aliphatic chain contains at least 10 carbon atoms.

A commercially available polymeric dispersant being a copolymer comprising between 3 and 11 mol % of a long aliphatic chain (meth)acrylate is Edaplan™ 482, a polymeric dispersant from MUNZING.

Polymer Latex Binders

Aqueous inkjet inks may contain a polymeric latex binder.

The polymer latex is not particularly limited as long as it has stable dispersibility in the ink composition. There is no limitation on the main chain skeleton of the water-insoluble polymer. Examples of the polymer include a vinyl polymer and a condensed polymer (e.g., an epoxy resin, polyester, polyurethane, polyamide, cellulose, polyether, polyurea, polyimide, and polycarbonate). Among the above, a vinyl polymer is particularly preferable because of easily controlled synthesis.

In a particularly preferred embodiment the polymer latex is a polyurethane latex, more preferably a self-dispersible polyurethane latex. The polymer latex binder in the one or more aqueous inkjet inks is preferably a polyurethane based latex binder for reasons of compatibility with the thermosetting resin.

The polymer latex in the invention is preferably a self-dispersing polymer latex, and more preferably a self-dispersing polymer latex having a carboxyl group, from the viewpoint of ejecting stability and stability of the liquid (particularly, dispersion stability) when using a colour pigment. The self-dispersing polymer latex means a latex of a water-insoluble polymer that does not contain a free emulsifier and that can get into a dispersed state in an aqueous medium even in the absence of other surfactants due to a functional group (particularly, an acidic group or a salt thereof) that the polymer itself has.

In preparing a self-dispersing polymer latex, preferably a monomer is used selected from the group consisting of an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxy methylsuccinic acid. Specific examples of the unsaturated sulfonic acid monomer include styrene sulfonic acid, 2-acrylamido-2-methyl propane sulfonic acid, 3-sulfopropyl (meth)acrylate, and bis-(3-sulfopropyl)-itaconate. Specific examples of the unsaturated phosphoric acid monomer include vinyl phosphoric acid, vinyl phosphate, bis(methacryloxyethyl)phosphate, diphenyl-2-acryloyloxyethyl phosphate, diphenyl-2-methacryloyloxyethyl phosphate, and dibutyl-2-acryloyloxyethyl phosphate.

The latex binder polymer particles preferably have a glass transition temperature (Tg) of 30° C. or more.

The minimum film-forming temperature (MFT) of the polymer latex is preferably −25 to 150° C., and more preferably 35 to 130° C.

Biocides

The aqueous inkjet ink preferably includes a biocide to prevent ink deterioration during storage by micro-organisms present in the water of the inkjet ink.

Suitable biocides for the aqueous inkjet inks include sodium dehydroacetate, 2-phenoxyethanol, sodium benzoate, sodium pyridinethion-1-oxide, ethyl p-hydroxybenzoate and 1,2-benzisothiazolin-3-one and salts thereof.

Preferred biocides are Proxel™ GXL and Proxel™ Ultra 5 available from ARCH UK BIOCIDES and Bronidox™ available from COGNIS.

A biocide is preferably added in an amount of 0.001 to 3.0 wt. %, more preferably 0.01 to 1.0 wt. %, each based on the total weight of the aqueous inkjet ink.

Humectants

A humectant is used in the aqueous inkjet ink to prevent water evaporation from a nozzle in the inkjet print head which can result in a failing nozzle due to clogging.

Suitable humectants include triacetin, N-methyl-2-pyrrolidone, 2-pyrrolidone, glycerol, urea, thiourea, ethylene urea, alkyl urea, alkyl thiourea, dialkyl urea and dialkyl thiourea, diols, including ethanediols, propanediols, propanetriols, butanediols, pentanediols, and hexanediols; glycols, including propylene glycol, polypropylene glycol, ethylene glycol, polyethylene glycol, diethylene glycol, tetraethylene glycol, and mixtures and derivatives thereof. Preferred humectants are 2-pyrrolidone, glycerol and 1,2-hexanediol, since the latter were found to be the most effective for improving inkjet printing reliability in an industrial environment.

The humectant is preferably added to the inkjet ink formulation in an amount of 0.1 to 35 wt % of the formulation, more preferably 1 to 30 wt % of the formulation, and most preferably 3 to 25 wt % of the formulation.

pH Adjusters

The aqueous inkjet inks may contain at least one pH adjuster. Suitable pH adjusters include NaOH, KOH, $NEt_3$, $NH_3$, HCl, $HNO_3$, $H_2SO_4$ and (poly)alkanolamines such as triethanolamine and 2-amino-2-methyl-l-propaniol. Preferred pH adjusters are triethanol amine, NaOH and $H_2SO_4$.

For dispersion stability, the aqueous inkjet ink preferably has a pH of at least 7.

Surfactants

The inkjet inks may contain at least one surfactant. The surfactant(s) can be anionic, cationic, non-ionic, or zwitterionic and are usually added in a total quantity less than 5 wt % based on the total weight of the inkjet ink and particularly in a total less than 2 wt % based on the total weight of the inkjet ink.

The inkjet inks preferably have a surface tension between 18.0 and 45.0 mN/m at 25° C., more preferably between a surface tension between 21.0 and 39.0 mN/m at 25° C.

Preferred surfactants are selected from fluoro surfactants (such as fluorinated hydrocarbons) and/or silicone surfactants.

The silicone surfactants are preferably siloxanes and can be alkoxylated, polyester modified, polyether modified, polyether modified hydroxy functional, amine modified, epoxy modified and other modifications or combinations thereof. Preferred siloxanes are polymeric, for example polydimethylsiloxanes. Preferred commercial silicone surfactants include BYK™ 333 and BYK™ UV3510 from BYK Chemie.

Preferred surfactants for the aqueous inkjet inks include fatty acid salts, ester salts of a higher alcohol, alkylbenzene sulphonate salts, sulphosuccinate ester salts and phosphate ester salts of a higher alcohol (for example, sodium dodecylbenzenesulphonate and sodium dioctylsulphosuccinate), ethylene oxide adducts of a higher alcohol, ethylene oxide adducts of an alkylphenol, ethylene oxide adducts of a polyhydric alcohol fatty acid ester, and acetylene glycol and ethylene oxide adducts thereof (for example, polyoxyethylene nonylphenyl ether, and SURFYNOL™ 104, 104H, 440, 465 and TG available from AIR PRODUCTS & CHEMICALS INC.).

Polymerizable Compounds

A UV curable inkjet ink includes one or more monomers and/or oligomers. The UV curable inkjet ink is preferably a free radical UV curable inkjet ink.

Any monomer and oligomer capable of free radical polymerization may be used in the free radical UV curable inkjet ink. The monomers and oligomers may have different degrees of polymerizable functionality, and a mixture including combinations of mono-, di-, tri-and higher polymerizable functionality monomers may be used. The viscosity of the UV curable inkjet ink can be adjusted by varying the ratio between the monomers and oligomers.

Particularly preferred for use as a polymerizable compound in the UV curable inkjet ink are monofunctional and/or polyfunctional (meth)acrylate monomers, oligomers or prepolymers.

Photoinitiators

The UV curable pigment inkjet inks preferably contains a photoinitiator. The initiator typically initiates the polymerization reaction. The photo-initiator may be a Norrish type I initiator, a Norrish type II initiator or a photo-acid generator, but is preferably a Norrish type I initiator, a Norrish type II initiator or a combination thereof.

A preferred Norrish type I-initiator is selected from the group consisting of benzoinethers, benzil ketals, -dialkoxyacetophenones, -hydroxyalkylphenones, -aminoalkylphenones, acylphosphine oxides, acylphosphine sulphides, -haloketones, -halosulfones and -halophenylglyoxalates.

A preferred Norrish type ll-initiator is selected from the group consisting of benzophenones, thioxanthones, 1,2-diketones and anthraquinones. A preferred co-initiator is selected from the group consisting of an aliphatic amine, an aromatic amine and a thiol. Tertiary amines, heterocyclic thiols and 4-dialkylamino-benzoic acid are particularly preferred as co-initiator.

Suitable photo-initiators are disclosed in CRIVELLO, J. V., et al. VOLUME III: Photoinitiators for Free Radical Cationic & Anionic Photopolymerization. 2nd edition. Edited by BRADLEY, G. London, UK: John Wiley and Sons Ltd, 1998. p. 287-294.

A preferred amount of photoinitiator is 0.3-50 wt % of the total weight of the UV curable inkjet ink, more preferably 1-15 wt % of the total weight of the UV curable inkjet ink.

In order to increase the photosensitivity further, the free radical UV curable inkjet ink may additionally contain co-initiators. Preferred examples of co-initiators can be categorized in three groups: 1) tertiary aliphatic amines such as methyldiethanolamine, dimethylethanolamine, triethanolamine, triethylamine and N-methylmorpholine; (2) aromatic amines such as amylparadimethylaminobenzoate, 2-n-butoxyethyl-4-(dimethylamino) benzoate, 2-(dimethylamino)ethylbenzoate, ethyl-4-(dimethylamino) benzoate, and 2-ethylhexyl-4-(dimethylamino)benzoate; and (3) (meth)acrylated amines such as dialkylamino alkyl (meth)acrylates (e.g., diethylaminoethylacrylate) or N-morpholinoalkyl-(meth)acrylates (e.g., N-morpholinoethylacrylate). The preferred co-initiators are aminobenzoates.

The amount of co-initiator or co-initiators is preferably from 0.01 to 20 wt %, more preferably from 0.05 to 10 wt %, based in each case on the total weight of the UV curable inkjet ink.

Polymerization Inhibitors

For improving the shelf-life of the inkjet ink, the UV curable inkjet ink may contain a polymerization inhibitor. Suitable polymerization inhibitors include phenol type antioxidants, hindered amine light stabilizers, phosphor type antioxidants, hydroquinone monomethyl ether commonly used in (meth)acrylate monomers, and hydroquinone, t-butylcatechol, pyrogallol may also be used.

Suitable commercial inhibitors are, for example, Sumilizer™ GA-80, Sumilizer™ GM and Sumilizer™ GS produced by Sumitomo Chemical Co. Ltd.; Genorad™ 16, Genorad™ 18 and Genorad™ 20 from Rahn AG; Irgastab™ UV10 and Irgastab™ UV22, Tinuvin™ 460 and CGS20 from Ciba Specialty Chemicals; Floorstab™ UV range (UV-1, UV-2, UV-5 and UV-8) from Kromachem Ltd, Additol™ S range (S100, S110, S120 and S130) from Cytec Surface Specialties.

Since excessive addition of these polymerization inhibitors will lower the ink sensitivity to curing, it is preferred that the amount capable of preventing polymerization is determined prior to blending. The amount of a polymerization inhibitor is preferably lower than 2 wt % of the total (inkjet) ink.

Preparation of Inkjet Inks

The inkjet inks may be prepared by precipitating or milling the colour pigment in the dispersion medium in the presence of the polymeric dispersant, or simply by mixing a self-dispersible colour pigment in the ink.

Mixing apparatuses may include a pressure kneader, an open kneader, a planetary mixer, a dissolver, and a Dalton Universal Mixer. Suitable milling and dispersion apparatuses are a ball mill, a pearl mill, a colloid mill, a high-speed disperser, double rollers, a bead mill, a paint conditioner, and triple rollers. The dispersions may also be prepared using ultrasonic energy.

If the inkjet ink contains more than one pigment, the colour ink may be prepared using separate dispersions for each pigment, or alternatively several pigments may be mixed and co-milled in preparing the dispersion.

The dispersion process can be carried out in a continuous, batch or semi-batch mode. UV curable inkjet inks are preferably prepared under conditions eliminating all possible incident UV light.

The preferred amounts and ratios of the ingredients of the mill grind will vary widely depending upon the specific materials and the intended applications. The contents of the milling mixture comprise the mill grind and the milling media. The mill grind comprises pigment, dispersant and a liquid carrier such as water. For ink-jet inks, the pigment is usually present in the mill grind at 1 to 50 wt %, excluding the milling media. The weight ratio of pigment over dispersant is 20:1 to 1:2.

The milling time can vary widely and depends upon the pigment, mechanical means and residence conditions selected, the initial and desired final particle size, etc. In the present invention pigment dispersions with an average particle size of less than 100 nm may be prepared.

After milling is completed, the milling media is separated from the milled particulate product (in either a dry or liquid dispersion form) using conventional separation techniques, such as by filtration, sieving through a mesh screen, and the like. Often the sieve is built into the mill, e.g. for a bead mill. The milled pigment concentrate is preferably separated from the milling media by filtration.

In general it is desirable to make the colour ink in the form of a concentrated mill grind, which is subsequently diluted to the appropriate concentration for use in the ink-jet printing system. This technique permits preparation of a greater quantity of pigmented ink from the equipment. If the mill grind was made in a solvent, it is diluted with water and optionally other solvents to the appropriate concentration. If it was made in water, it is diluted with either additional water or water miscible solvents to make a mill grind of the desired concentration. By dilution, the ink is adjusted to the desired viscosity, colour, hue, saturation density, and print area coverage for the particular application.

REFERENCE SIGNS LIST

TABLE 19

| | |
|---|---|
| 1 | Paper roll |
| 2 | Coating head |
| 3 | Single pass inkjet printer |
| 4 | Printed paper substrate |
| 5 | Thermosetting resin bath |
| 6 | Cutter |
| 7 | Decorative layer (resin impregnated printed paper sheet) |
| 8 | Protective layer |
| 9 | Core layer |
| 10 | Balancing layer |
| 11 | Heating press |
| 12 | Decorative panel |
| 13 | Multi-pass inkjet printer |
| 14 | Transport system to multi-pass inkjet printer |
| 15 | Transport system to heating press |
| 16 | Groove |
| 17 | Tongue |
| 18 | Unprinted resin impregnated paper sheet |

What is claimed is:

1. A method of manufacturing decorative laminates including a wood based color pattern, the method comprising the steps of:

inkjet printing a first decorative layer using a first multi-pass inkjet printer to form a printed first decorative layer;

applying a first protective layer to the printed first decorative layer;

delivering the printed first decorative layer to a laminate heating press and heat pressing the printed first decorative layer to a first decorative laminate;

inkjet printing a second decorative layer using a second multi-pass inkjet printer to form a printed second decorative layer;

applying a second protective layer to the printed second decorative layer;

delivering the printed second decorative layer to the laminate heating press and heat pressing the printed second decorative layer to a second decorative laminate; wherein the steps of inkjet printing the first and second decorative layers includes printing on an ink acceptance layer using pigmented aqueous inkjet inks from a CRYK ink set;

the first and second protective layers include a thermosetting resin impregnated paper substrate; and the first and second decorative laminates each include a core layer selected from the group consisting of Medium Density Fibreboard and High Density Fibreboard.

2. The method according to claim 1, wherein the ink acceptance layer is present on a surface of a thermosetting resin impregnated paper substrate.

3. The method according to claim 1, wherein the ink acceptance layer includes a polymer selected from the group consisting of hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinyl acetal; polyvinyl pyrrolidone; polyacrylamide; acrylamide/acrylic acid copolymer; polystyrene, styrene copolymers; acrylic or methacrylic polymers; styrene/acrylic copolymers; ethylene-vinylacetate copolymer; vinyl-methyl ether/maleic acid copolymer; poly(2-acrylamido-2-methyl propane sulfonic acid); poly(diethylene triamine-co-adipic acid); polyvinyl pyridine; polyvinyl imidazole; polyethylene imine epichlorohydrin modified; polyethylene imine ethoxylated; ether bond-containing polymers such as polyethylene oxide (PEO), polypropylene oxide (PPO), polyethylene glycol (PEG), and polyvinyl ether (PVE); polyurethane; melamine resins; gelatin; carrageenan; dextran; gum arabic; casein; pectin; albumin; chitins; chitosans; starch; collagen derivatives; collodion; and agar-agar.

4. The method according to claim 3, wherein the ink acceptance layer further includes an inorganic pigment.

5. The method according to claim 4, wherein the inorganic pigment is selected from the group consisting of alumina hydrates, aluminum oxides, aluminum hydroxides, aluminum silicates, and silicas.

6. The method according to claim 1, wherein the ink acceptance layer includes a polyvinylalcohol polymer and a porous silica pigment.

7. The method according to claim 1, wherein the first and second decorative layers have different color patterns.

8. The method according to claim 1, wherein the first and second multi-pass inkjet printers are two to four pass inkjet printers.

9. The method according to claim 1, wherein each of the first and second multi-pass inkjet printers include 8 to 64 piezoelectric print heads.

10. The method according to claim 1, wherein a color of the thermosetting resin impregnated paper substrate or the ink acceptance layer for the first decorative layer is different from a color of the thermosetting resin impregnated paper substrate or the ink acceptance layer for the second decorative layer.

* * * * *